United States Patent [19]

Lobanoff

[11] 3,936,221

[45] Feb. 3, 1976

[54] VERTICAL CANTILEVER PUMP

[75] Inventor: Valenteen S. Lobanoff, Seneca Falls, N.Y.

[73] Assignee: Goulds Pumps, Inc., Seneca Falls, N.Y.

[22] Filed: Sept. 16, 1974

[21] Appl. No.: 506,017

[52] U.S. Cl. ..... 415/200; 415/169 A; 415/214; 417/424

[51] Int. Cl.[2] ..... F04D 1/00; F04D 7/00

[58] Field of Search ..... 415/111, 169 A, 214 R, 415/200, 197; 417/424 R

[56] References Cited

UNITED STATES PATENTS

| | | | |
|---|---|---|---|
| 2,181,973 | 12/1939 | Jasberg | 415/214 |
| 2,458,068 | 1/1949 | Fuller | 415/169 A |
| 2,890,660 | 6/1959 | Umbricht | 415/213 R |
| 3,105,445 | 10/1963 | Gabbioneta | 415/197 |
| 3,205,176 | 9/1965 | Tenney | 415/214 |
| 3,255,702 | 6/1966 | Gehrm | 415/214 |
| 3,767,321 | 10/1973 | Layne | 415/210 |
| 3,824,042 | 7/1974 | Barnes et al. | 417/424 |

FOREIGN PATENTS OR APPLICATIONS

| | | | |
|---|---|---|---|
| 209,244 | 7/1957 | Australia | 415/197 |
| 845,260 | 8/1960 | United Kingdom | 415/169 A |

OTHER PUBLICATIONS

Publication Sethco Pump Co., Horizontal Series Bulletin P6–H, 6 pp.

*Primary Examiner*—Henry F. Raduazo
*Attorney, Agent, or Firm*—Bean & Bean

[57] ABSTRACT

A vertical cantilever pump featuring a novel pump shaft construction for preventing excessive or an abnormal rise of pumped liquid therealong without a substantial reduction in pumping efficiency.

2 Claims, 1 Drawing Figure

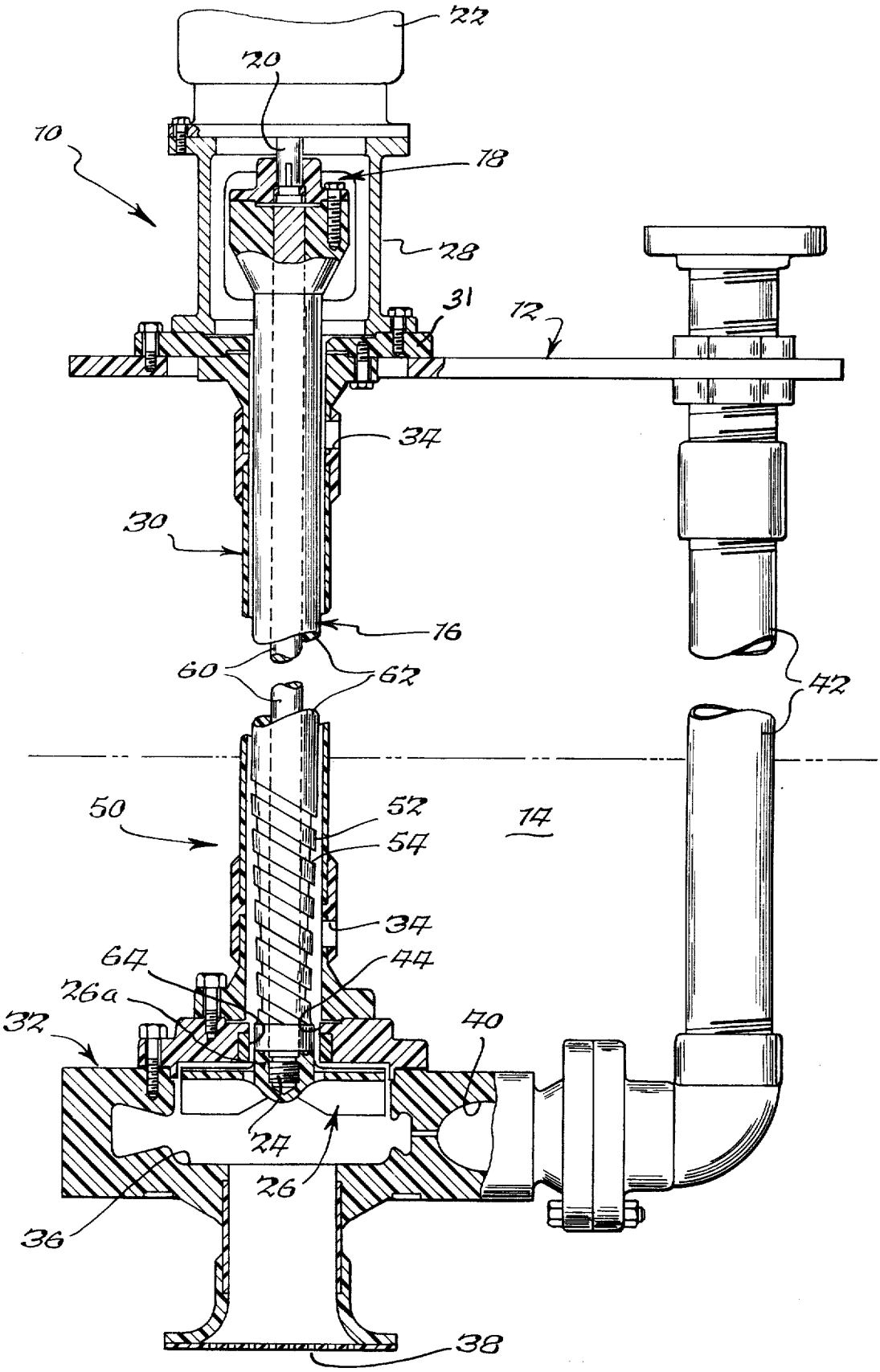
22
20
10
18
28
31
12
34
30
16
60
62
42
50
52
54
14
34
64
44
26a
32
40
24
26
36
38

VERTICAL CANTILEVER PUMP

BACKGROUND OF THE INVENTION

The invention relates to improvements for increasing the pumping efficiency of vertical cantilever pumps of the type adapted to handle highly corrosive and/or abrasive liquids.

A typical prior art cantilever pump construction, such as that disclosed in U.S. Pat. No. 2,355,472, includes a vertically extending pump drive shaft, which serves to mount an impeller adjacent its lower end and is arranged to extend downwardly through a pedestal, which in turn serves to mount an impeller enclosing pump head casing or housing. The corrosive and/or abrasive nature of the liquid being pumped requires the provision of a relatively loose fit between the pump shaft and the pump head casing with the result that a portion of the pumped liquid is free to escape from the casing upwardly along the pump shaft. Normally, the pedestal is of an open construction in order to permit the escaping liquid to be immediately returned to the main body of the liquid being pumped before it can rise to a height at which it will escape from the liquid receiving tank and/or damage the pump drive motor or its bearings. Thus, a decided drawback of the type of pump construction disclosed in U.S. Pat. No. 2,355,472 is that the "loss" of pumped liquid results in a substantial reduction in the efficiency of the pump.

In an effort to minimize the internal leakage under operating conditions and thus increase the potential output or discharge of the pump for a given capacity pump motor, it has been proposed to form a pedestal of substantially closed construction such that the escaping liquid establishes a column of liquid opposing further escape. However, as a practical matter, during a normal pumping operation, the "safe height" of this liquid column, i.e. the height below that at which liquid might escape from the holding tank is insufficient to arrest the escape of liquid from the pump chamber, and thus the side wall of the pedestal is necessarily formed with openings to permit continuous bleeding or flow of liquid from the column back into the liquid bath. Moreover, from time to time a back pressure may be encountered in the pump discharge conduit, which is substantially in excess of normal pump discharge pressure, as for instance due to closing of an outlet valve, while the pump is in operation. This increase in back pressure will tend to produce a substantial increase in the normal height of the column of escaping liquid, thereby to reduce the value of the so-called safe height of the column and as a result limit the efficiency of the pump.

U.S. Pat. No. 2,622,537 discloses a cantiliver pump construction, which represents a compromise between the fully open and substantially closed pedestal constructions described above. Specifically, in this pump construction the pedestal is substantially closed in order to provide a column of liquid within the pedestal for opposing escape of pumped liquid, while at the same time the interior of the pedestal is placed in communication with the inlet of the pump in order to continuously withdraw escaping fluid from the pedestal.

SUMMARY OF THE INVENTION

The present invention is directed to a vertical cantilever pump having substantially improved pumping efficiency and more particularly to a novel pump shaft construction for inhibiting or controlling the escape of pumped fluid from the pump head casing. The conventional stuffing boxes and antifriction bearings are eliminated, and all thrust loads are carried by the motor bearings.

The present cantilever pump construction employs a novelly designed pump shaft, which is arranged within a pedestal of a substantially closed construction and employed to prevent excessive or uncontrolled rise of pumped liquid upwardly along the pump shaft without experiencing a substantial reduction in pumping efficiency.

In accordance with the present invention, an essentially cylindrical pedestal is dimensioned to closely bound a pump shaft, which has its lower end portion configured to define a pumping device serving to cooperate with the pedestal in opposing the rise of a column of liquid within the pedestal to an abnormal height at which damage to the pump motor and/or its drive shaft bearing support might occur. Preferably, the lower end portion of the pump shaft is both tapered in a direction downwardly towards the impeller to define a pumping surface and also provided with a spiralwise extending pumping groove. An effective pumping action is obtained when the lower end portion of the pump shaft is formed with a two degree taper, but pumping efficiency has been found to increase as the taper is increased to about seven degrees; this constituting a practical limit normally imposed by the geometry and structural considerations of a cantilever pump installation.

In a desirable form of the present invention, essentially the entire pump construction is of a non-metallic material, such as glass reinforced thermoset composites including polyester and epoxy material of the type disclosed in my co-pending application Ser. No. 335,671, filed Feb. 26, 1973. It is also a feature of the present invention that the pump shaft may be fabricated by winding plastic coated glass filament about a small diameter starting shaft or mandrel, which may if desired, be of metal or plastic, to produce a solid shaft having a degree of rigidity substantially exceeding that of conventionally fabricated pump shafts.

DRAWING

The single drawing FIGURE is a partially sectionalized side elevational view of a cantilever pump employed in the present invention.

DETAILED DESCRIPTION

In the drawing, a cantilever pump assembly formed in accordance with the present invention is generally designated as 10 and shown in association with a mounting plate 12 by which it is supported relative to a holding tank, not shown, containing a liquid 14. The pump is particularly designed for pumping highly corrosive and/or abrasive materials.

Pump assembly 10 generally includes a vertically extending pump drive shaft 16, which has its upper end rigidly connected by a coupling 18 to the drive shaft 20 of a motor 22 and has its lower end suitably fixed, as for instance by screw threads 24, to an impeller 26 having a hub portion **26*a*. Motor 22 is suitably affixed to mounting plate 12, as by an upstanding pedestal 28, which is preferably of an open construction in order to afford ready access to coupling 18.**

Pump assembly 10 also includes a depending essentially cylindrical pedestal 30, which has its upper end fixed to mounting plate 12 in a bracket 31 and has its lower end fixed to a pump head casing or housing 32. Pedestal 30 may be characterized as relatively closely bounding pump shaft 16 and as having an essentially closed construction, that is, a construction where its interior is placed only in limited flow communication with the holding tank, as by relatively small vertically spaced openings 34. While the pedestal is shown as substantially cylindrical it is obvious that the lower end portion could be tapered to conform substantially to the taper of the lower end portion of the pump shaft.

Casing 32 defines a pump chamber 36, which receives impeller 26, an inlet opening 38 for placing the pump chamber in flow communication with the holding tank; an outlet opening 40 for placing the pump chambeer in flow communication with discharge conduit 42; and a central opening 44 for receiving pump shaft 16 and hub portion 26*a*.

As used herein, the term "cantilever" refers to the manner in which pump shaft 16 is mounted; that is coupled by a rigid connection to the motor drive shaft and having no other contact or support. In this connection, it will be understood that it is impractical to utilize bearing and gland devices to support and seal the pump shaft and particularly the lower end portion thereof relative to the pump head casing 32, due to the nature of the liquid being pumped. the absence of means to support and center the lower end portion of pump shaft 16 within casing opening 44 necessitates that the latter be dimensioned to provide a relatively loose fit with hub portion 26*a* and the pump shaft in order to avoid rubbing contact between parts. As a result, a portion of the fluid being pumped would normally escape from pump chamber 36 upwardly along the pump shaft through opening 44 to establish a tubular column of liquid within pedestal 30. The normal height of this column is proportional to the normal pumped liquid discharge pressure present in discharge conduit 42, whereas the percentage of pumped fluid lost due to leakage through opening 44 increases as the diameter of hub portion 26*a* and thus opening 44 increases. For purposes of the present description, the hub portion may be considered, depending on impeller design, as including a conventional impeller back ring portion, not shown, which is in the form of an annular rib extending from the rear or upper surface of the impeller concentrically of the illustrated hub portion and cooperates with opening 44 to define an annular opening through which pumped fluid may escape from pump chamber 36. As a practical matter, for impellers of this design, the diameter of such back ring portion will increase as the diameter of the impeller increases, whereas the diameter of the illustrated hub portion tends to correspond to the diameter of the pump shaft, which is determined by shaft length and pump horsepower requirements. In any event, it will be understood that the percentage of pumped fluid lost through opening 44 increases as the size of the impeller and thus its associated hub portion, including back ring, increases.

The present invention seeks to significantly increase the efficiency of a cantilever pump over that previously obtainable without permitting excessive or damage producing travel of liquid upwardly along the pump shaft upon occurrence of a back pressure in the discharge conduit in excess of normal discharge pressure. To this end, the lower end portion of pump shaft 16 is shaped to define a pump device 50 operable as a result of normal shaft rotational movements to create a downwardly "directed" high pressure condition within a relatively closely fitting lower portion of pedestal 30 for opposing escape of liquid through opening 44. Pedestal 30 also relatively closely bounds the upper end portion of the pump shaft, so that any tubular column of liquid, which reaches the upper portion area, has a relatively thin wall thickness. The percentage of axial length of pump shaft 16 occupied by pump device 50 and the radial distance between the pump shaft and pedestal 30 will vary, depending upon installation requirements and pump capacity.

Pump device 50 preferably comprises two pumping elements in the form of a downwardly tapering pumping surface 52 and a spiralwise pumping groove 54 formed in such surface.

An efficient pumping operation may be obtained when pumping surface 52 is formed with about a two degree taper. Pumping efficiency has been found to increase as the taper is increased, but structural and design considerations for most pump installations create a practical limitation of about 7° taper.

Pumping groove 54 preferably has a sharp corner, general rectangular cross-sectional configuration, with the number of "threads" per given length of pump shaft or groove pitch varying depending upon pumping or "back pressure" requirements.

While either of these pump elements alone will serve to increase pumping efficiency over that obtainable with prior cantilever pump constructions, pump efficiency is maximized by shaping the lower end of the pump shaft to provide both of the pumping elements, and by employing the largest diameter pump shaft, which is commensurate with pump installation and horsepower requirements.

As by way of example, for a pump having a straight pump shaft of approximately 3 feet in length and 3¼ inches in diameter, a diametral or total clearance between the pump shaft and the pedestal of approximately ¼ inch; and a capacity of up to about 1000 gpm, the leakage through opening 44 has been found to be approximately 8 percent of total pump capacity. The impeller was of the type having a back ring of approximately a 6 inch diameter.

By employing the tapered and grooved pump shaft of the present invention in the above described example pump, leakage may be reduced to 3.78 percent of pump capacity. This reduction in loss of pumped fluid and resultant increase in pump efficiency was achieved by providing the pump shaft with a 3° taper and a spiral groove having a width of ½ inch, a depth of ¼ inch and a pitch of 1 inch.

I claim:

1. A vertical cantilever pump adapted for use in pumping liquids of a corrosive and/or abrasive nature, said pump comprising a vertically downwardly extending cylindrical support pedestal having a pump casing adjacent its lower end for positioning same within a bath of liquid confined by a tank, said pump casing having an opening in an upper wall thereof and a liquid inlet and a pumped liquid outlet, and a pump drive shaft freely extending downwardly through said pedestal and said pump casing opening for supporting an impeller within said pump casing, said pedestal being arranged in flow communication with said pump casing through said pump casing opening and said pedestal being of a substantially closed construction whereby pumped liquid escaping from said pump casing through said pump casing opening upwardly along said pump shaft and into said pedestal forms a tubular column of liquid tending to reach a normal height proportional to normal pumped liquid discharge pressure, said pedestal and said impeller and said casing being formed of a fiber glass synthetic resin thermoset composite resistant to said liquid, said pump shaft being formed with a lengthwise extending metal core element fixed to said impeller and a covering sleeve bonded to said core element for shielding same from contact with said liquid and cooperating therewith to define an extremely rigid pump shaft, said covering sleeve being formed of a wound fiber glass synthetic resin thermoset composit resistant to said liquid, said covering sleeve having its surface shaped to define a pump device cooperating with a relatively closely positioned bounding surface of said pedestal for creating a downwardly directed force acting on said pumped liquid escaping from said pump casing for maintaining said column at a height below an abnormal height permitting escape of liquid from said tank upon occurrence of a back pressure in excess of said normal pumped liquid discharge pressure, and said covering sleeve surface being tapered relative to said bounding surface of said pedestal in a direction downwardly towards said impeller and defining a spiralwise extending pumping groove.

2. A pump according to claim 1 wherein said pumping groove is of constant depth.

* * * * *